US005351115A

United States Patent [19]

Yamamoto et al.

[11] Patent Number: 5,351,115

[45] Date of Patent: Sep. 27, 1994

[54] COLOR ELECTROPHOTOGRAPHIC METHOD AND APPARATUS EMPLOYED THEREFOR

[75] Inventors: Hajime Yamamoto, Ibaragi; Hiroshi Terada, Ikoma, both of Japan

[73] Assignee: Matsushita Electric Industrial Co., Ltd., Osaka, Japan

[21] Appl. No.: 872,187

[22] Filed: Apr. 22, 1992

[30] Foreign Application Priority Data

| | | | |
|---|---|---|---|
| May 23, 1991 | [JP] | Japan | 3-118266 |
| May 23, 1991 | [JP] | Japan | 3-118269 |
| May 23, 1991 | [JP] | Japan | 3-118284 |
| Jul. 16, 1991 | [JP] | Japan | 3-175079 |

[51] Int. Cl.[5] ..... G03G 15/01

[52] U.S. Cl. ..... 355/326 R; 355/327; 346/48; 346/157

[58] Field of Search ..... 355/326, 327, 328, 211, 355/245, 254, 255, 270; 346/157, 44, 46, 48, 49, 51, 160.1; 118/645, 655; 400/119, 120 MC, 120 MP, 82, 206; 358/296, 300, 302; 430/42

[56] References Cited

U.S. PATENT DOCUMENTS

| | | | |
|---|---|---|---|
| 3,117,891 | 1/1964 | Lehmann . | |
| 4,159,166 | 6/1979 | Kasahara et al. | 355/327 X |
| 4,371,253 | 2/1983 | Day et al. | 355/327 |
| 4,622,563 | 11/1986 | Watanabe | 400/120 X |
| 4,775,868 | 10/1988 | Sugiura | 400/120 X |
| 4,897,677 | 1/1990 | Lai | 400/119 X |
| 5,014,094 | 5/1991 | Amitani | 355/326 |
| 5,177,542 | 1/1993 | Lubberts | 355/271 |
| 5,282,012 | 1/1994 | Terada et al. | 355/327 |
| 5,298,949 | 3/1994 | Yamamoto et al. | 355/211 X |

FOREIGN PATENT DOCUMENTS

| | | | |
|---|---|---|---|
| 0086455 | 8/1983 | European Pat. Off. . | |
| 0376732 | 7/1990 | European Pat. Off. . | |
| 1522670 | 10/1969 | Fed. Rep. of Germany . | |
| 2361062 | 6/1975 | Fed. Rep. of Germany . | |
| 3228094 | 2/1983 | Fed. Rep. of Germany . | |
| 3610559 | 11/1986 | Fed. Rep. of Germany | 400/120 MC |
| 0207021 | 12/1973 | Japan | 355/327 |
| 0001039 | 1/1979 | Japan | 355/327 |
| 0124687 | 7/1983 | Japan | 400/120 MC |
| 0072776 | 4/1985 | Japan | 400/206 |
| 0063062 | 3/1988 | Japan | 355/327 |
| 0188159 | 8/1988 | Japan | 355/326 |
| 1252982 | 10/1989 | Japan . | |
| 2016580 | 1/1990 | Japan . | |
| 8101120 | 4/1981 | World Int. Prop. O. | 400/119 |

OTHER PUBLICATIONS

English Abstract of Japanese patent 2-156260 dated Jun. 15, 1990.

*Journal of Patent Abstracts of Japan,* vol. 14, No. 405, "Multicolor Image Recorder", T. Kodera, Aug. 31, 1990 (P-1100) (4348).

*Primary Examiner*—Matthew S. Smith

*Attorney, Agent, or Firm*—Ratner & Prestia

[57] ABSTRACT

A color electrophotographic apparatus employing a plurality of image forming units each including a photoreceptor and a corona charger, and using toner. In the apparatus, the image forming units are arranged to be displaceable, with an exposure position of an exposure device and a transfer position of a transfer paper holding member being fixed. During image formation, the image forming unit is moved to a predetermined position, and the obtained color image transferred onto paper sheet on a transfer paper holding member. Each of the image forming unit has a first image forming position confronting the transfer paper holding member, and a second image forming position different from the first image forming position.

In the color electrophotographic method of the present invention, when a photoreceptor using time in each single color image forming process for the color image formation is represented by T, and time for electrostatically resting the photoreceptor until the next use of the photoreceptor is denoted by t, the process in the relation of $T<t$ is repeated. By this electrophotographic arrangement, a compact color electrophotographic apparatus simple in construction may be obtained, with a high speed operation during the single color image formation, and favorable nature for maintenance. Furthermore, by the apparatus of the present invention, stable images may be obtained even during continuous use, without fatigue of the photoreceptor and undesirable temperature rise.

11 Claims, 8 Drawing Sheets

COLOR ELECTROPHOTOGRAPHIC METHOD AND APPARATUS EMPLOYED THEREFOR

BACKGROUND OF THE INVENTION

The present invention generally relates to electrophotography, and more particularly, to a color electrophotographic process and an apparatus employed therefor which may be applied to a printer, facsimile device or the like.

In the field of the color electrophotographic apparatus as referred to above, there has conventionally been proposed, for example, an apparatus in which four image forming units each containing a photosensitive member or photoreceptor and a color developing material are successively arranged along a paper transport path so that development in full color may be effected according to colors, as disclosed, for example, in Japanese Patent Laid-Open Publication Tokkaihei No. 2-16580 as shown in FIG. 1.

In FIG. 1, there is illustrated only a printer portion, i.e. an image forming portion of a copying apparatus disclosed in said Tokkaihei No. 2-16580. Digital signals sent from an image reading portion (not particularly shown) of the apparatus, are inputted to the printer portion, and fed to laser light exposure devices of color signals respectively for black 1BK, cyan 1C, magenta 1M, and Yellow 1Y at which four recording units 2BK, 2C, 2M, and 2Y are arranged side by side as shown. Since each of said recording units is composed of the same constitutional parts, description will be given only with respect to the recording unit 2C for cyan, and explanation for those of other colors is abbreviated for brevity, with like parts being designated by like reference numerals affixed with letters representing colors for quick reference. Here, the representative recording unit 2C is provided with a photosensitive or photoreceptor drum 3C besides the laser exposure device 1C. Around the photoreceptor drum 3C, there are sequentially disposed various processing stations such as a corona charger 4C, the laser exposure device 1C, a developing unit 5C and a transfer charger 6C, etc. The photosensitive surface of the photoreceptor drum 2C uniformly charged by the corona charger 4C is formed thereon with a latent image of cyan light image through exposure by the exposure device 1C and the latent image is developed in a visible image by the developing unit 5C.

Thus, copy paper (not shown) is successively fed by a transfer belt 7 in the form of an endless belt movably supported by a pair of rollers between the photoreceptor drums 3BK, 3C, 3M, and 3Y respectively formed with visible images in the above described manner, and is transferred with the visible images by the action of the transfer units 6, whereby a full color image may be obtained on the copy paper.

Moreover, in the color image electrophotographic apparatus generally used, a practice to form the color image by overlapping toner images in respective colors for yellow, magenta, cyan and black has been adopted, and a general process for effecting the overlapping of such toner images on the transfer material is described, for example, in a color image forming apparatus disclosed in Japanese Patent Laid-Open Publication Tokkaihei No. 1-252982.

FIG. 2 schematically shows an overall construction of the prior art color image forming apparatus referred to above.

In FIG. 2, the known color image forming apparatus generally includes a photosensitive or photoreceptor drum 8 rotatably provided approximately at a central portion of an apparatus housing H, and various processing stations such as a corona charger 9, a developing section 10, a transfer drum 11, and a cleaner 12, etc. sequentially disposed around the photoreceptor drum 8. The developing section 10 constituted by a Y developing unit 13 for forming toner image in yellow, an M developing unit 14 for toner image in magenta, a C developing unit 15 for toner image in cyan, and a B developing unit 16 for toner image in black is arranged to be rotated on the whole so that respective developing units successively confront the photosensitive surface of the photoreceptor drum 8 so as to be in the state capable of effecting the developing. The transfer drum 11 and the photoreceptor drum 8 are respectively rotated in directions indicated by arrows as they confront each other during operation.

In the first place, upon starting operation, the photoreceptor drum 8 is rotated in the direction indicated by the arrow, with the photosensitive surface thereof being uniformly charged ty the corona charger 9.

Thereafter, the photosensitive surface of the photoreceptor drum 8 is irradiated by the laser beam modulated through the signal for forming the image of the first color yellow, whereby the latent image is formed thereon, which is further developed by the developing unit 13 for yellow firstly confronting said photoreceptor drum 8, so as to be formed into a yellow toner image. Before the yellow toner image thus formed arrives at the position confronting the transfer drum 11, a copy paper sheet fed from a paper feeding section 18 has already been wound onto the outer peripheral surface of said transfer drum 11, with the leading edge of the copy paper sheet being grasped by a claw portion 19, and the toner image is formed at a timing in which the yellow toner image on the photoreceptor drum 8 faces and meets predetermined position of the paper sheet.

After the yellow toner image on the photoreceptor drum 8 has been transferred onto the paper sheet by the action of a transfer charger 20, the photosensitive surface of the photoreceptor drum is cleaned by the cleaner 12 so as to be prepared for the formation of the image of the next color. Subsequently, toner images for magenta, cyan, and black are formed in the similar manner, at which time, the developing section 10 causes each of the developing units to be used according to the colors to confront the photoreceptor drum 8 so as to be ready for the developing. The transfer drum 11 has a sufficient diameter so that the change-over of the developing units is effected in time and the toner image of the previous color is overlapped with that of the next color.

The irradiation of the laser beam L for the image formation of each color is effected in such a timed relation that, as the photoreceptor drum 8 and the transfer drum 11 rotate, the toner image of each color on the photoreceptor drum 8 and the toner image already transferred onto the paper sheet over the transfer drum 11 are positionally aligned or registered with each other. In such a manner, the toner images in four colors are transferred onto the paper sheet in the superposed state over the transfer drum 11, thereby to form the color image on said paper sheet. After the toner images for all colors have been transferred thereon, the paper sheet is separated from the transfer drum 11 by a separating claw 21, and then, fixed with the toner image by a fixing unit 23 through a transfer section 22 so as to be subsequently discharged out of the apparatus. Given so far is the brief description of the construction and function of the conventional color image forming apparatus.

However, in the arrangement as described with reference to FIG. 1, there has been such a problem that the construction of the developing apparatus tends to be on a large scale, and the recording unit for each color becomes large and complicated, while four laser exposure devices are required, thus resulting in high cost.

Meanwhile, in the arrangement of FIG. 2 in which the transfer drum 11 is employed for aligning the positions of the toner images in different colors as overlapped, it is necessary to once winding the paper sheet around the transfer drum for transferring the toner image on the photoreceptor drum onto said paper sheet, even when an image in a single color is to be formed through employment of only one of the developing units, and thus, copying speed for the single color mode becomes slow as compared with that of an usual single color copying apparatus.

Moreover, since the transfer drum originally unnecessary during the single color copying is operated, maintenance and replacement of parts particular to the transfer drum are also required in the similar manner as in the color copy, even when a large amount of single color copying is effected in the above color image forming apparatus of FIG. 2.

Furthermore, in the arrangements of FIGS. 1 and 2, when color images are continuously printed under high temperature circumstances, since the photoreceptor drum is also continuously used, charge potential thereof is gradually lowered due to electrostatic fatigue and temperature rise of the photoreceptor, with a consequent variation in the image quality obtained.

SUMMARY OF THE INVENTION

Accordingly, an essential object of the present invention is to provide a color electrophotographic apparatus which is arranged to effect positioning of toner images for respective colors through employment of a transfer drum during color copying, and which is capable of forming images in the similar function as in a general single color apparatus without employment of the transfer drum during single color copying.

Another object of the present invention is to provide a color electrophotographic apparatus of the above described type which is compact in size and simple in construction, and stable in functioning at high reliability.

A further object of the present invention is to provide a color electrophotographic method which can provide stable images without fatigue of the photoreceptor or undesirable rise in temperature even during continuous use.

In accomplishing these and other objects, according to one aspect of the present invention, there is provided a color electrophotographic apparatus which includes a plurality of movable image forming units each having at least a photosensitive member and a developing unit, a transfer paper holding member for holding transfer paper on its surface so as to transfer toner image onto the transfer paper, and a single exposure device with the respective developing units of said image forming units having toner in a plurality of colors and with a transfer position of said transfer paper holding member and the exposure position of said exposure device being fixed. The color electrophotographic apparatus further includes a moving means of said image forming units so controlled as to displace said image forming units in turn, to the same image forming position during the color image formation whereby, after forming an electrostatic latent image on the photosensitive member of said image forming unit by said exposure device and developing said electrostatic latent image by color toner, the toner images are transferred onto the paper sheet held on the transfer paper holding member to form the color image on the transfer paper.

In another aspect of the present invention, the color electrophotographic apparatus includes a plurality of movable image forming units each having at least a photosensitive member and a developing unit, a transfer paper holding member for holding transfer paper so as to transfer toner image onto the transfer paper, and an exposure means, with the respective developing units of said image forming units having toner in a plurality of colors. Each of said image forming units having a first image forming position confronting said transfer paper holding member, and another image forming position different from said first image forming position.

In a further aspect of the present invention, there is provided a color electrophotographic method which includes the steps of forming respective single color images in a plurality of colors, and combining said respective single color images to form a color image, wherein, when time for using the photosensitive member during said respective single color image forming step for the color image formation is represented by T, and time for electrostatically resting the photosensitive member up to the next use of said photosensitive member, by t, a step in a relation of $T<t$ is repeated to form the color image.

In a still further aspect of the present invention, the color electrophotographic method for continuously forming the same image for a plurality of times includes the steps of forming the color by combining a plurality of single color images, and electrostatically resting a photosensitive member employed therefor during continuous use thereof for the color image formation.

In another aspect of the present invention, the color electrophotographic method includes the steps of forming respective single color images in a plurality of colors, and combining said respective single color images to form a color image, wherein time for electrostatically resting a photosensitive member employed therefor is provided between said respective single color image formations in the plurality of colors.

In still another aspect of the present invention, the color electrophotographic apparatus includes a plurality of image forming units each having at least a photosensitive member and a developing unit, a transfer paper holding member for holding transfer paper so as to transfer toner image onto the transfer paper, and a single exposure device, the respective developing units of said image forming units having toner in a plurality of colors with a transfer position of said transfer paper holding member and the exposure position of said exposure device being fixed. The color electrophotographic apparatus further includes a moving means of said image forming units so controlled as to rotate the group of said image forming units on the whole and, to displace said image forming units in turn, to the same image forming position during the color image formation whereby, after forming an electrostatic latent image on the photosensitive member of said image forming unit by said exposure device and developing said electrostatic latent image by color toner, the toner images are transferred onto the paper sheet held on the transfer paper holding member to form the color image on the transfer paper.

By displacing the compact image forming units as described above, it becomes possible to unify the exposure device, and thus, the construction of the apparatus on the whole is simplified, with a consequent reduction in size.

Moreover, since the first image forming position confronting the transfer paper holding member and the second image forming position different therefrom are provided for the image forming unit, it is not necessary to hold the transfer paper on the transfer paper holding member in the single color printing mode, and the image formation may be effected in the function similar to that of the single color image forming apparatuses in general. Additionally, necessity for maintenance due to deterioration of the transfer paper holding member, etc. may be markedly reduced.

Furthermore, according to the color electrophotographic method of the present invention, since the step for electrostatically resting the photosensitive member is provided between the image formations, the photosensitive member is free from fatigue or temperature rise even during continuous use, with the electrostatic characteristic thereof stabilized, thereby to obtain images of constant quality at all times.

Another advantage of the present invention is such that, since the fundamental blocks required for the color overlapping are reduced to two portions, i.e. the group of the image forming units and the transfer paper holding member, the arrangement of the apparatus on the whole is simplified for reduction in size.

Furthermore, for the developing material to be applied to the present invention, a dual-component developing material composed of a mixture of toner and magnetic carrier can be employed.

The toner employed in the present invention is prepared by dispersing coloring pigments such as carbon black, phthalocyanine or the like into a binder resin, e.g. styrene resin or acrylic resin, for classification after grinding. Such toner may be of a powder obtained by a spray drying or that chemically obtained by suspension polymerization, etc. Moreover, the toner particles may be mixed into the carrier as they are, or may be those prepared by adhering very fine particles of silica or fluoro-resin onto surfaces of toner depending on the conditions for use. The average diameter of the toner used should preferably be less than 15 μm, and when reduced below 12 μm, sharper images were obtained. When the average diameter thereof was reduced to less than 5 μm, transfer performance was lowered or insufficient cleaning of toner took place.

For the carrier to be applied to the present invention, magnetic materials such as iron particles, ferrite powder, etc., or such materials coated with resin on the surfaces thereof, magnetic particles prepared by dispersing and mixing fine particles of ferrite powder and magnetite into styrene resin, epoxy resin, styrene acrylic resin, etc. by about 30 to 80% for subsequent grinding and classification are employed. The average diameter of the carrier should preferably be less than 300 μm, and especially, when it is reduced to be below 150 μm, it becomes possible to uniformly charge the toner.

Meanwhile, the mono-component toner to be employed for the present invention is prepared by dispersing powder of magnetite, ferrite or the like into a binder resin such as styrene resin or acrylic resin together with an electrical charging control agent for classification after grinding. Depending on the using conditions, the toner particles may be those prepared by adhering very fine particles of silica or fluoro-resin onto surfaces of toner. The average diameter of the toner used should preferably be less than 15 μm, and when reduced below 12 μm, sharper images were obtained.

For the photosensitive member or photoreceptor to be employed for the present invention, organic photoreceptors using zinc oxide, selenium, cadmium sulfide, phthalocyanine, azo pigment, etc. can be adopted. These photoreceptors tend to be lowered in the resistance thereof at high temperatures in the similar manner as in the general semiconductors, with consequent reduction in the charge holding performance.

BRIEF DESCRIPTION OF THE DRAWINGS

These and other objects and features of the present invention will become apparatus from the following description taken in conjunction with the preferred embodiment thereof with reference to the accompanying drawings, in which.

DETAILED DESCRIPTION OF THE INVENTION

Figure 1:
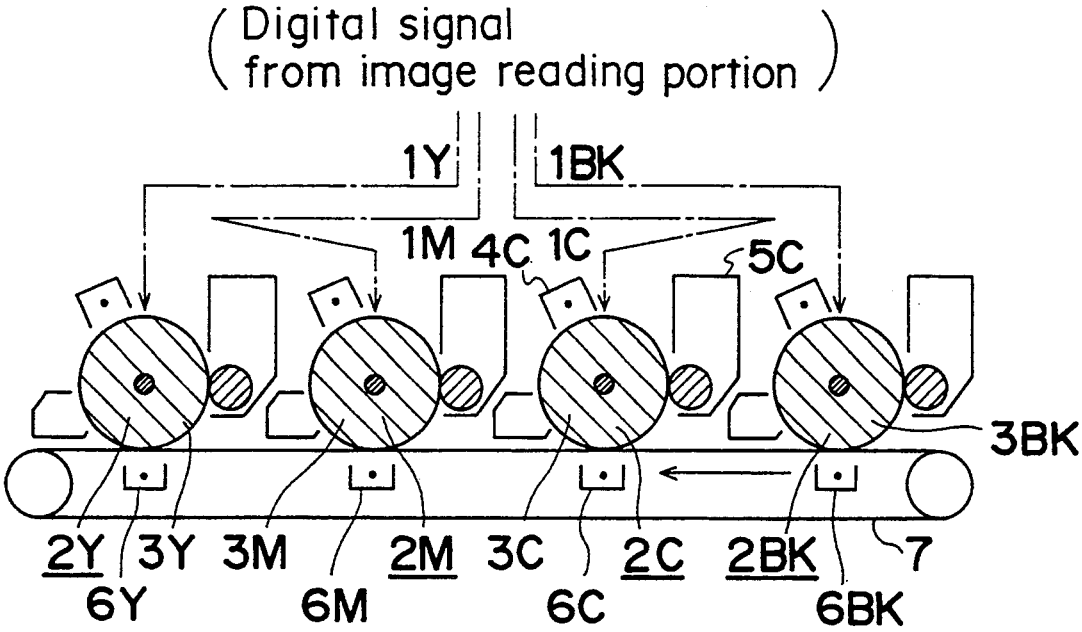
Fig.1 PRIOR ART
FIG. 1 is a schematic side sectional view only of a printer portion, i.e. image forming portion of a first conventional color electrophotographic apparatus (already referred to)

Before the description of the present invention proceeds, it is to be noted that like parts are designated by like reference numerals throughout the accompanying drawings.

Embodiment 1

Figure 3:
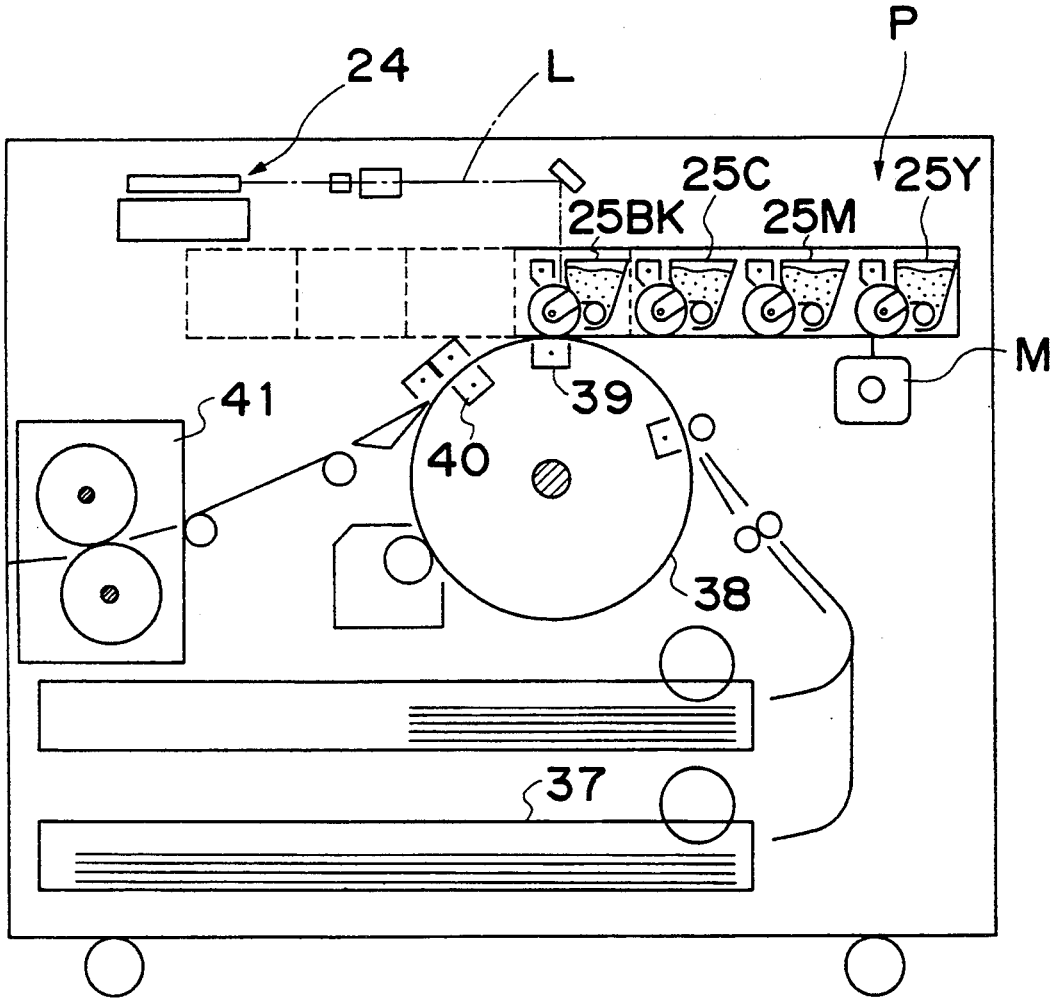
FIG. 3 is a schematic side sectional view of a color electrophotographic apparatus according to one preferred embodiment of the present invention mainly showing an image forming portion thereof.
Figure 4:
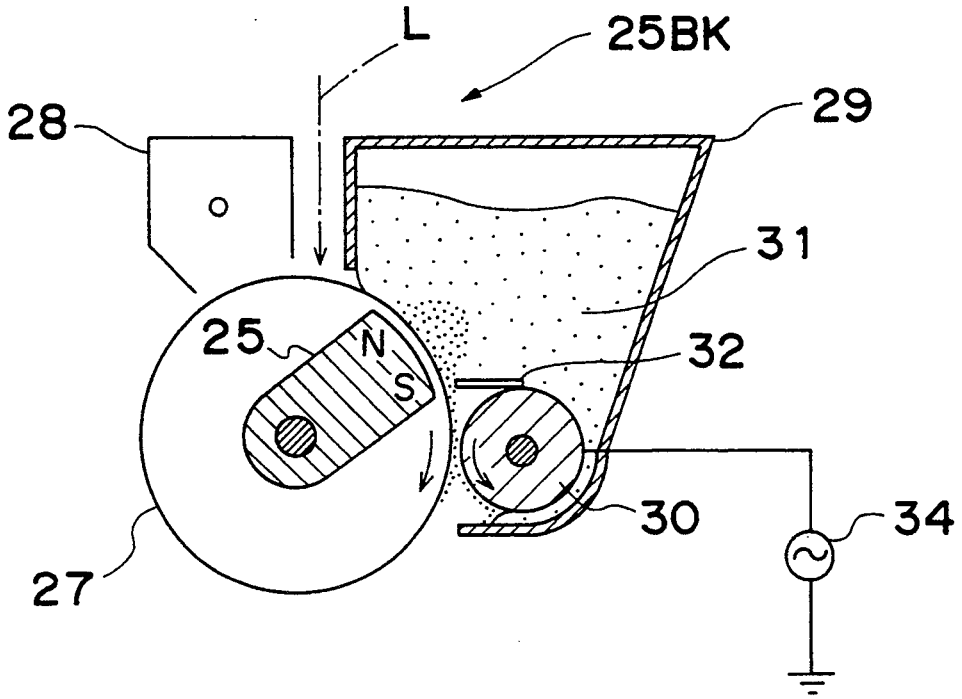
FIG. 4 is a schematic side sectional view showing on an enlarged scale, an image forming unit of the present invention employing a mono-component toner.

Referring to FIG. 3, there is schematically shown a color electrophotographic apparatus, mainly a printer portion P or image forming portion thereof, according to one preferred embodiment of the present invention. In FIG. 3, color digital signals are inputted to the printer portion P so as to be fed to a laser light exposure device 24. Within the printer portion P, there are disposed four sets of image forming units 25BK, 25C, 25M, and 25Y side by side, which are movable and arranged to be sequentially displaced by a moving means M, to the same image forming position during formation of color images. Since each of the image forming units 25 is composed of the same constitutional parts except for the developing material to be accommodated therein, description will be given only with respect to the image forming unit 25BK for black, and explanation for the units of other colors is abbreviated for brevity, with like parts being designated by like reference numerals affixed with letters representing colors for quick reference. Thus, the representative image forming unit 25BK for black as shown on an enlarged scale, in FIG. 4 is provided with a rotatable photosensitive or photoreceptor drum 27 having a magnet 26 enclosed therein, a corona charger 28, and a toner hopper 29 having a toner collecting electrode roller 30 rotatably disposed at a lower portion of the hopper 29 in a position confronting the photoreceptor drum 27 and a toner restricting plate 32 provided above and adjacent to said roller 30 which is connected to an A.C. high voltage source 34, with a monocomponent toner 31 being contained in said hopper 29. Within the photoreceptor drum 27, the magnet 26 is fixed in its position, with the pole position thereof facing the interior of the toner hopper 29. The surface of the photoreceptor drum 27 is charged at −400 V by the corona charger 28, and thereafter, exposed to laser light L from the exposure device 24 to be formed with an electrostatic latent image thereon. Then, the magnetic mono-component toner 31 contained in the toner hopper 29 is magnetically attracted onto the surface of the photoreceptor drum 27 so as to adhere the toner onto the surface of the photoreceptor drum 27 for developing the electrostatic latent image formed thereon into a visible toner image. The amount of toner to be adhered onto the surface of the photoreceptor drum 27 is restricted by the toner restricting plate 32, to a thickness of about 50 μm, and thereafter, the adhered toner is passed in front of the toner collecting electrode roller 30 disposed to confront the surface of the photoreceptor drum 27 through a gap of 300 μm as the photoreceptor drum 27 rotates. For developing the latent image on the photoreceptor into the visible image, the A.C. voltage (frequency: 1 kHz, AC: 1K Vrms, DC bias: −350 V) was applied to the toner collecting electrode roller 30 by the A.C. high voltage source 34.

Figure 5:
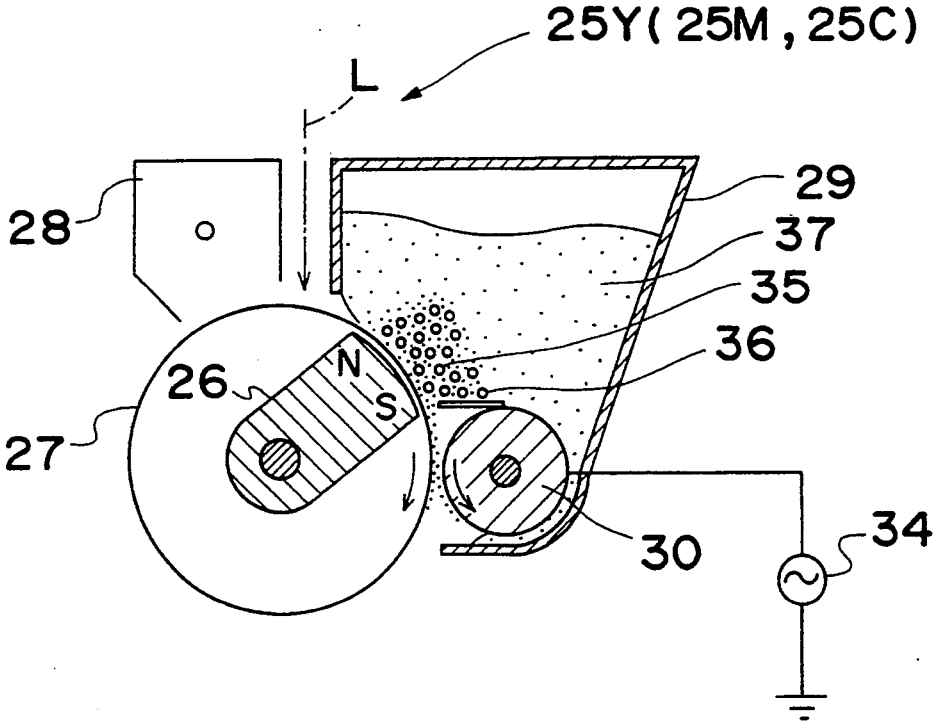
FIG. 5 is a view similar to FIG. 4, which particularly shows an image forming unit of the present invention employing a dual-component toner.

FIG. 5 shows the construction of the image forming unit for each of yellow, magenta and cyan in colors. Although the constitutional parts of the units are the same as those of the image forming unit for black as shown in FIG. 4, the composition of the developing material 35 to be accommodated in the toner hopper 29 is different from that of the magnetic mono-component toner 31 in FIG. 4. In FIG. 5, the developing material 35 is of a dual-component developing material composed of magnetic carrier 36 and color toner 37. The color toner 37 is adapted to contact the carrier 36 for triboelectrical charging so as to be electrostatically adhered to the surface of the photoreceptor drum, with other image forming processes being the same as in the case of black described earlier.

Referring back to FIG. 3, the process of forming a full color image will be explained hereinafter.

From a tray for a required size of a paper feeding unit 37, a transfer paper (not particularly shown) is supplied so as to be wound around a transfer paper holding member 38 composed of a polyester film of 100 μm in thickness. In the first place, the image forming unit 25BK for black is disposed to the image forming position by a moving means M, and black component signal light is projected by the laser light exposure device 24. The latent image formed thereby is developed into a visible toner image in the image forming unit 25BK, and said toner image is transferred onto the paper sheet by the action of a transfer charger 39. Then, the image forming unit 25C for cyan is displaced by the moving means M, to the position where the image forming unit 25BK for black was present for displacement therewith, and similar image forming process was repeated by using the image forming unit 25C for cyan, subsequently, the image forming unit 25M for magenta, and finally, the image forming unit 25Y for yellow, and thus, a beautiful full color image was obtained on the transfer paper sheet. Thereafter, the paper sheet was separated from the transfer paper holding member 38 by a separating charger 40 for heat fixing of the image by a fixing unit 41, and thus, the desired full color image was obtained.

Embodiment 2

Figure 6:
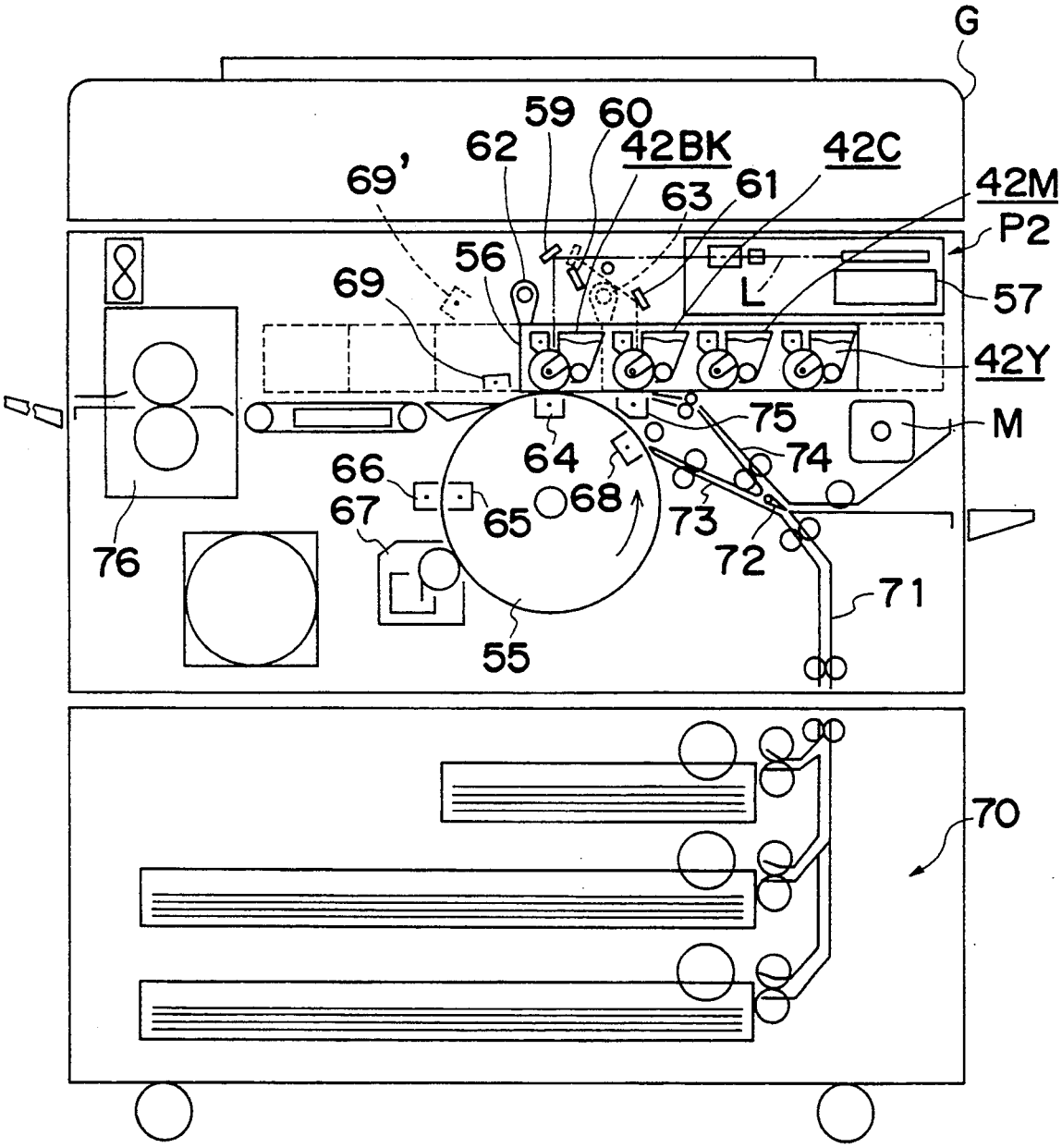
FIG. 6 is a schematic side sectional view of a color electrophotographic apparatus showing the state of the printer portion for image formation during color mode.
Figure 7:
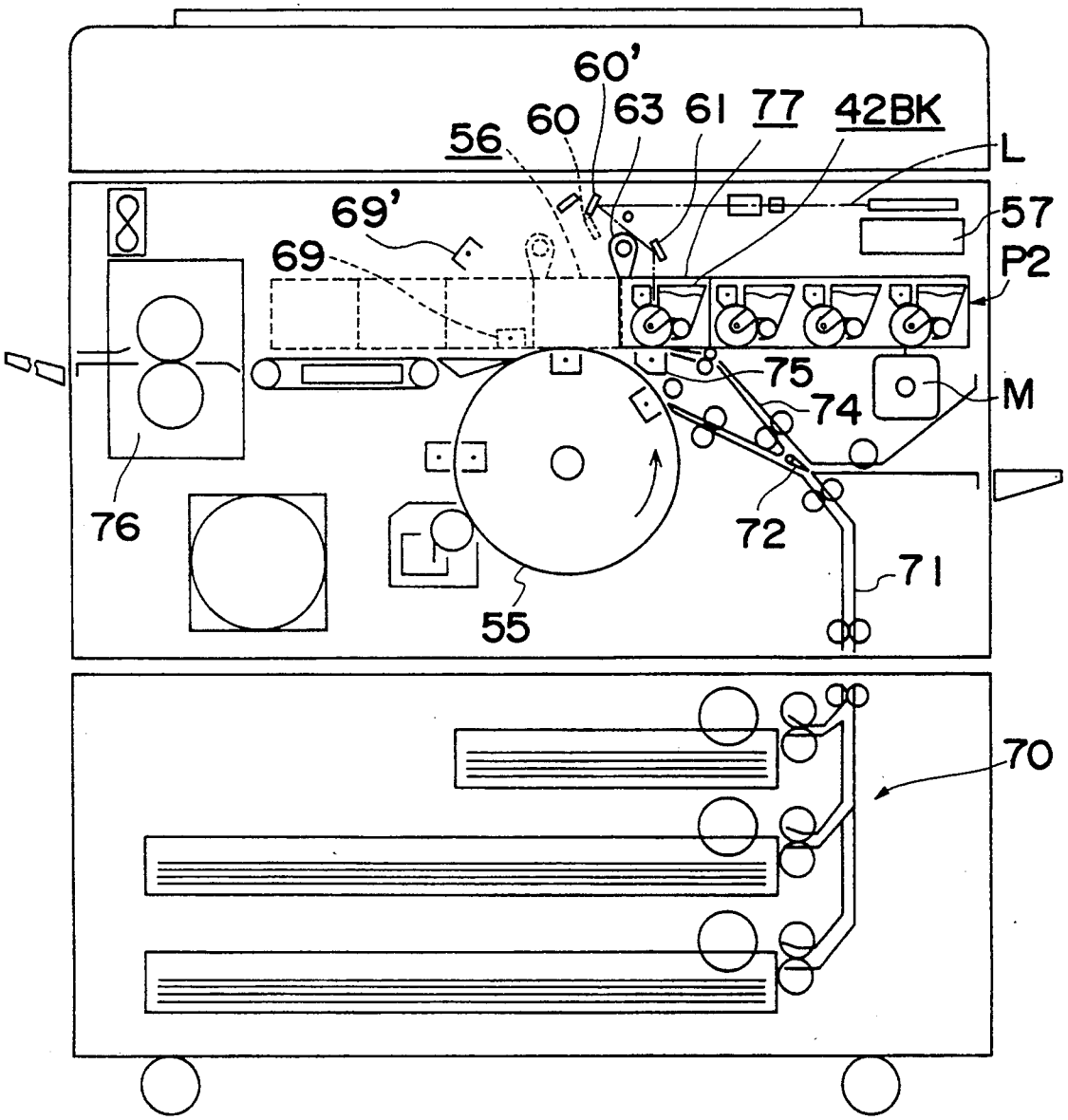
FIG. 7 is a view similar to FIG. 6, which particularly shows the state of the printer portion during single color mode.

Referring to FIGS. 6 and 7, there is shown a color electrophotographic apparatus according to another embodiment of the present invention mainly with respect to the printer portion P2 thereof, in which FIG. 6 represents the state of the apparatus during color mode, while FIG. 7 denotes the state thereof during the single color mode. As shown in FIGS. 6 and 7, there are also disposed in the print portion P2, four sets of image forming units 42BK, 42C, 42M, and 42Y side by side, which are laterally movable on the whole and arranged to be sequentially displaced by a moving means M, to a first image forming position 56 confronting a transfer paper holding member 55. Since each of the image forming units 42 is composed of the same constitutional parts except for the developing material to be accommodated therein, description will be given only with respect to the image forming unit 42BK black, and explanation for the units of other colors is abbreviated for brevity, with like parts being designated by like reference numerals affixed with letter representing colors for quick reference.

Figure 8:
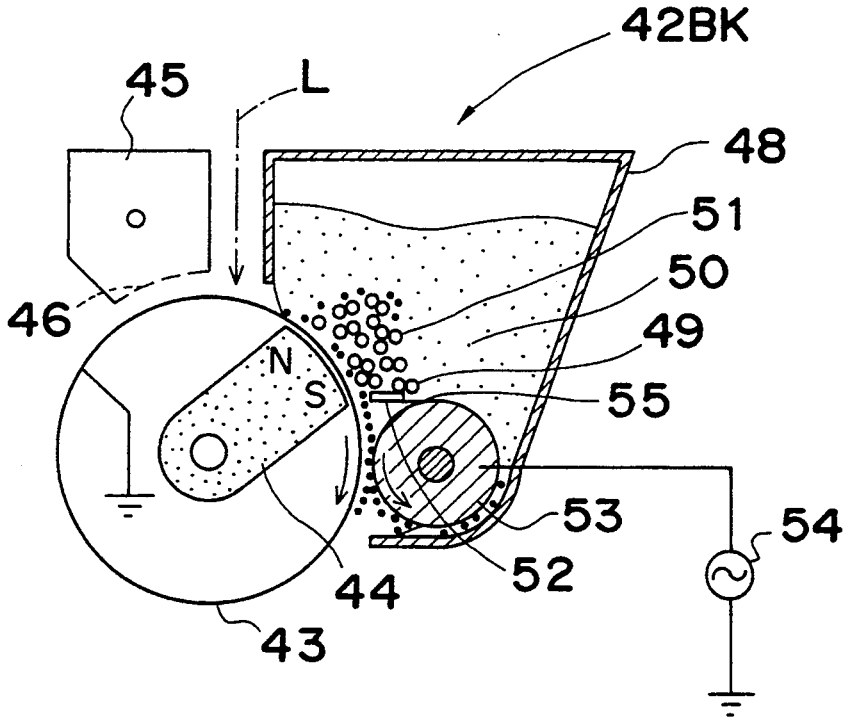
FIG. 8 is a schematic side sectional view of an image forming unit for black employed in the arrangement of FIGS. 6 and 7.

The image forming unit 42BK for black as shown on an enlarged scale in FIG. 8, includes an organic photoreceptor drum 43 composed of a material in which phthalocyanine is dispersed in a polyester group binder resin, a magnet 44 of two poles fixed to the same shaft as that of the photoreceptor drum 43 and enclosed in said drum 43, a corona charger 45 for negatively charging the surface of the photoreceptor drum 43 provided with a grid electrode 46 for controlling the charging potential of the photoreceptor drum 43, and a toner hopper 48 having a toner collecting electrode roller 53 of alumina material rotatably disposed at a lower portion of the hopper 48 in a position confronting the photoreceptor drum 43 and connected to an A.C. high voltage source 54 to be applied with a high voltage thereby. The toner collecting electrode roller 53 is further provided with a toner amount restricting plate 52 of a magnetic nickel material and a scraper 55 of a polyester film for scraping the toner off the surface of the toner collecting electrode roller 53. Flux density on the surface of the photoreceptor drum 43 is 800 Gs, and said photoreceptor drum 43 had a diameter of 30 mm, and was rotated at a circumferential speed of 30 mm/s.

Within the toner hopper 48, a dual-component developing material 51 prepared by mixing carrier 49 of iron particles having particle diameter of 100 μm and coated on the surfaces with silicone resin, with toner 50 was placed, so as to be adhered onto the surface of the photoreceptor drum 44 by the magnetic force. The toner 50 employed was prepared by mixing 5% of carbon black and 2% of hydroxy carboxylic acid metallic complex with styrene acrylic resin, with external addition of 0.1% of colloidal silica (each by weight %).

Referring particularly to FIG. 8, functioning of the electrophotographic apparatus having the constructions as described so far will be explained.

Figure 9:
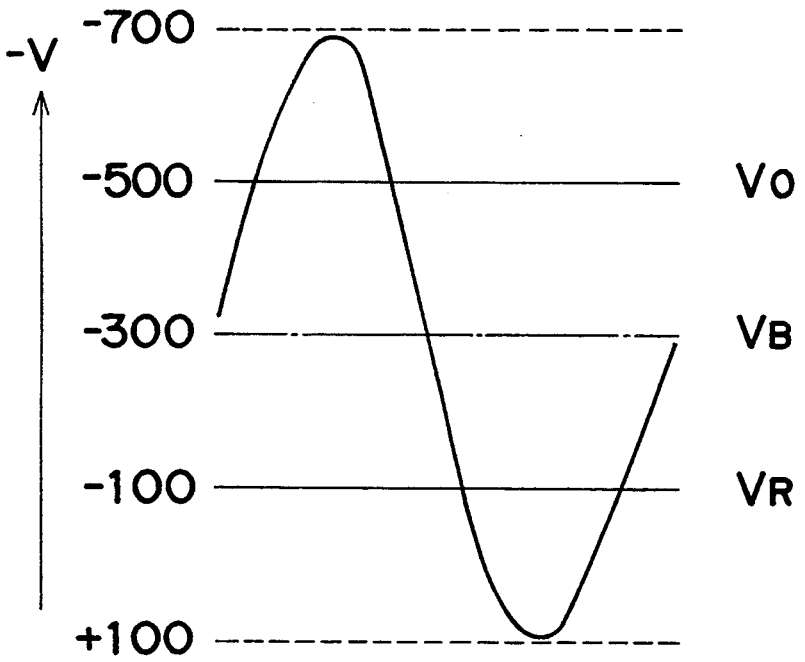
FIG. 9 is a graphical diagram showing waveforms of voltages to be applied to a toner collecting electrode roller according to the present invention.

The surface of the photoreceptor drum 43 was charged at −500 V by the corona charger 45. (impressed voltage −4 Kv, voltage of the grid 46: −500 V). The laser beam scanning light L was projected onto the photoreceptor drum 43 to form the electrostatic latent image. The exposure potential for the photoreceptor drum 43 at this time was −100 V. When the photoreceptor drum 43 thus formed with the electrostatic latent image is passed through the developing material 51, although such dual-component developing material 51 attracted by the magnet does not move, only the toner 50 moves together with the photoreceptor drum 43, and after passing through the toner amount restricting plate 52, a uniform toner layer of about 30 μm was formed on the surface of the photoreceptor drum 43. At this time, a voltage of −500 V was applied to the toner amount restricting plate 52, and the toner was charged at about −3 μC/g. Subsequently, the photoreceptor drum 43 to which the toner layer adhered was passed in front of the toner collecting electrode roller 53, which was impressed with an A.C. voltage of 400 V o-p (peak to peak at 800 V) superposed with D.C. voltage of −300 V having waveforms as shown in FIG. 9 by the high voltage power source 54. The toner layer on the surface of the photoreceptor drum 43 was subjected to motion between the photoreceptor drum 43 and the toner collecting electrode roller 53, and the toner at the non-image portion was gradually moved towards the side of the roller 53, and on the surface of the photoreceptor drum 43, a negative-positive reversed image was left only at the image portion.

The toner adhering onto the toner collecting electrode roller 53 is scraped off by the scraper 55 so as to be returned into the toner hopper 48 again for use in the subsequent image formation. Thus, the toner image in black is obtained on the photoreceptor drum 43. The developers, i.e. image forming units 42C, 42M and 42Y other than the unit 42BK for black have the similar construction, and are subjected to similar image forming process.

Referring back to FIG. 6, the construction of the printer portion P2 in the state for the color mode will be explained in the first place. The image forming units 42BK, 42C, 42M and 42Y arranged side by side are laterally moveable on the whole, and the respective image forming units may be sequentially positioned at the first image forming position 56 facing the transfer paper holding member 55. A laser light exposure device 57 is arranged to produce laser beam scanning light L modulated by the signal inputted to the printer portion P2, and in the state of FIG. 6, the light L is reflected by a reflecting mirror 59 so as to be projected onto the surface of the photoreceptor drum 43 of the image forming unit located at the first image forming position 56. Reflecting mirrors 60 and 61 are intended to be used for the single color mode, and in the state of FIG. 6, they are out of the light path without functioning. Erasing lamps 62 and 63 are fixed to the apparatus main body, and one lamp 62 is located at a position for irradiating the surface of the photoreceptor drum 43 of the image forming unit positioned at the first image forming position 56, while the other lamp 63 is located at a position for acting on the image forming unit at the right side of the above unit.

The transfer paper holding member 55 is fundamentally constituted by a polyester film of 100 μm in thickness formed into a cylindrical shape, and arranged to transfer toner images of four colors at the same position of the paper sheet attracted on its surface while the holding member 55 effects four rotations. The transfer paper holding member 55 is provided, at its interior corresponding in position to the first image forming position, with a transfer charger 64, and further, includes erasers 65 and 66 for erasing the toner image after the transfer, paper sheet, and polyester film, etc., a cleaner 67, and an attracting charger 68, etc., for attracting the paper sheet onto the polyester film thereof. A separating charger 69 is provided for separating the paper sheet from the polyester film of the holding member 55 after completion of all transfer operation, and this charger 69 is adapted to be displaced at a position indicated by 69' when the image forming unit is moved towards the left side from the state of FIG. 6. At the lower portion of an apparatus housing G, there is provided a paper feeding section 70 having three paper trays for copy paper sheets of different sizes, from which the desired paper sheet is fed to the transfer paper holding member 55 through a paper feeding passage 71, and by being guided into a first passage 73 by the action of a change-over claw 72 in the state of FIG. 6. A second paper feeding passage 74 and a transfer charger 75 do not function during the color mode. At the left side in FIG. 6, a fixing device 76 is provided for fixing the toner image on the paper sheet after the transfer.

So far, the main construction of the electrophotographic apparatus of the present invention and the state thereof during the color mode have been explained.

Subsequently, image forming function in the above case will be described.

The paper sheet (not particularly shown) is supplied from the paper feeding portion 70, and is wound onto the transfer paper holding member 55 by the action of the attracting charger 68 through the paper feeding passages 71 and 73 referred to above. In the first place, with respect to the position in FIG. 6, the respective image forming units have been displaced towards the left, and the image forming unit 42Y for yellow is located at the first image forming position 56 confronting the transfer paper holding member 55, and thus, the yellow component signal light is subjected to exposure by the laser beam L. The latent image thus formed is developed into a visible toner image within the image forming unit 42Y as described earlier, and the toner image is transferred onto the paper sheet by the action of the transfer charger 64. Thereafter, the respective image forming units are displaced towards the right, and the image forming unit 42M for magenta is displaced to the first image forming position 56 where the image forming unit for yellow was placed for exchanging, and similar image forming process is effected. At this time, the transfer paper holding member 55 wound with the paper sheet has completed one rotation, and the toner image of magenta is transferred at the same position for yellow image on the paper sheet. Such process is repeated in the similar manner, through employment of the unit for cyan, and finally, that for black, and thus, a beautiful full color image was obtained on the transfer paper sheet. Thereafter, the paper sheet was separated from the transfer paper holding member 55 by the separating charger 69 for final heat fixing by the fixing device 49, and thus, a desired full color fixed image was obtained. So far, functioning during the color mode for the electrophotographic apparatus according to the present embodiment has been described.

Subsequently, functioning thereof during the single color mode will be explained with reference to FIG. 7. For the single color mode, since the general construction of the apparatus on the whole is the same as in the color mode, with a difference only of the state for part of the constituting elements, functioning will be explained with reference to such part.

During the single color mode, the image forming units are at the position shown in FIG. 7, and the image forming unit 42BK for black is located at the image forming position 77, with the transfer charger 75 for the single color mode being provided to correspond thereto. The eraser lamp 63 is to act on said image forming unit 42BK. For the single color mode, the reflecting mirror 60 is shifted to a position as at 60', and the laser beam scanning light L emitted from the laser exposure light device 57 is reflected by the reflecting mirrors 60' and 61, and is projected onto the photoreceptor drum of the image forming unit 42BK for black located at the second image forming position 77. The changeover claw 72 at the rear portion of the paper feeding passage 71 is located at a position as shown in FIG. 7, and the paper sheet fed from the paper feeding passage 71 is supplied to the second image forming position 77 this time through the paper feeding passage 74. Here, the separating charger 69 has been shifted to the position 69' as shown in FIG. 7.

With the respective parts of the apparatus being in the state as described above, the paper sheet fed from the paper feeding portion 70 is transferred with the toner image for black at the second image forming position 77 through the paper feeding passages 71 and 74, and in this case, fed to the fixing device 76 by passing above the transfer paper holding member 55 thereafter. In the above case, the transfer paper holding member 55 is only rotating, and various chargers and others are not functioning. Therefore, deterioration at each part of the transfer paper holding member, and soiling, etc. hardly take place in this mode.

Embodiment 3

Referring back to FIGS. 6 and 8 again, the color electrophotographic method according to the present invention will be described hereinafter.

In this embodiment, the photoreceptor drum 43 for each of the image forming units was set at 30 mm in diameter, and was rotated at a circumferential speed of 180 mm/s. Through employment of such image forming unit, the image formation was effected by adopting the same process as in the embodiment 2 described above.

Figure 10:
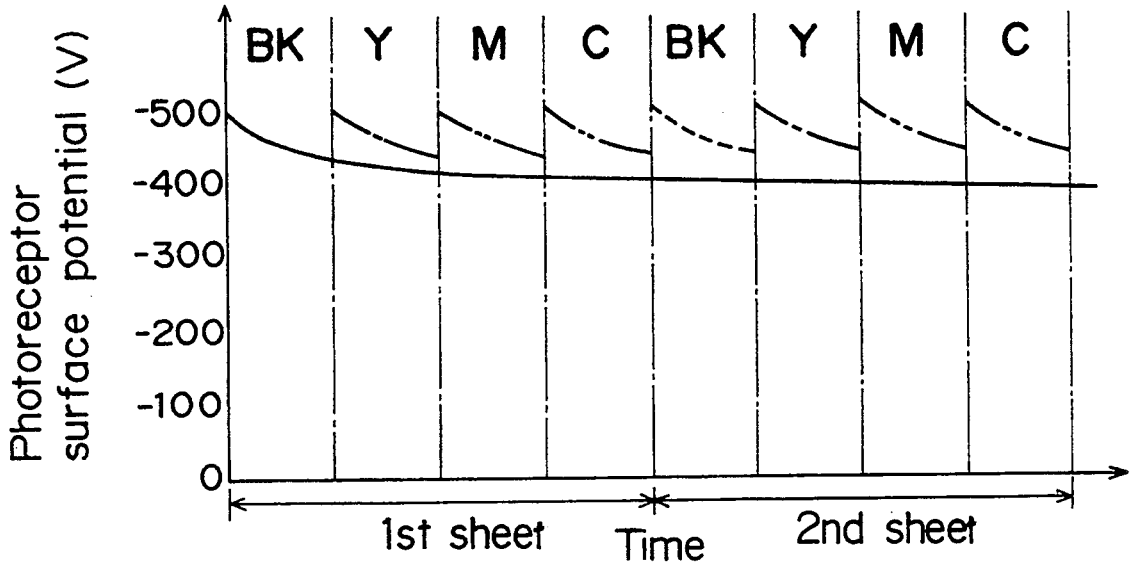
FIG. 10 is a graphical diagram for explaining transition of charging voltages for the photosensitive member according to the present invention.

In the above case, variations of charge potentials for the photoreceptor drums used in the respective image forming units 42BK, 42Y, 42M, and 42C at environmental temperature of 40° C. (at temperature of 45° C. within the apparatus), are shown in FIG. 10 respectively by a dotted line, one-dotted chain line, two-dotted chain line, and three-dotted chain line. A solid line in FIG. 10 shows a variation of charge potential when the same photoreceptor was continuously used.

As shown in FIG. 10, when the photoreceptor is continuously used under high temperature, the surface potential thereof is gradually lowered, with consequent variation of the obtained image, but upon adoption of the arrangement as in the present embodiment, the photoreceptors for the respective image forming units are not subjected to electrostatic stresses such as corona charging, light erasing, etc. so as to be left in a dark place, while temperature rise can also be suppressed since rotation of the photoreceptor drum is suspended. In the above case, when the photoreceptor using time at each single color image forming process for the color image formation is represented by T, time t for electrostatically resting the photoreceptor up to the next use of the subsequent photoreceptor of the same image forming unit may be maintained at approximately three times of T, and during that time, the photoreceptor may be fully recovered from the electrostatic fatigue, so as to effect image formation at the next use with the same potential characteristic as before. Consequently, beautiful color images may be stably obtained at all times. According to experiments, when the relation between the photoreceptor using time T and the photoreceptor resting time t was at $T<t$, effective results were obtained.

Embodiment 4

Subsequently, the effect of the color electrophotographic method according to the present invention will be explained by referring to FIG. 6 again, with respect to the functioning for continuously producing 100 sheets of color print.

Color images were formed by effecting operation similar to that as explained in the embodiment 2, during which, at every 10 sheets in the color image formation, rotation of the photoreceptor drum was left suspended for 10 seconds in order to electrostatically rest the photoreceptor, and thereafter, the color image forming process was started again. In the manner as described above, even under the environmental temperature at 40° C., beautiful color images could be stably obtained for continuous 100 sheets.

Embodiment 5

Figure 2:
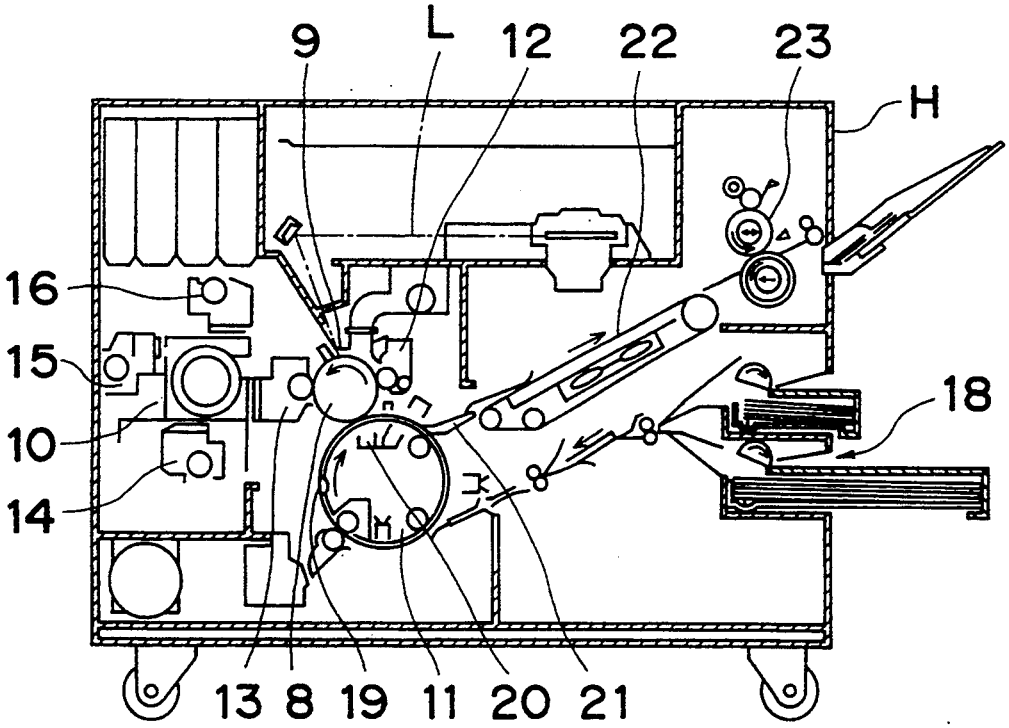
Fig.2 PRIOR ART
FIG. 2 is a schematic side sectional view of a second conventional color electrophotographic apparatus (already referred to)

Subsequently, through employment of the conventional color printer as shown in FIG. 2, the effect of the color electrophotographic method according to the present invention will be explained.

In FIG. 2, as the photoreceptor drum 8 is rotated in the direction indicated by an arrow, the surface thereof is uniformly charged by corona charger 9. Thereafter, the laser beam L modulated by a signal for forming a yellow image for the first color is projected onto the surface of the photoreceptor drum 8, thereby to form an electrostatic latent image, which is then first developed by the developer 13 for yellow confronting the photoreceptor drum 9, and thus, the yellow toner image was formed. By the time when the yellow toner image thus formed arrives at the position confronting the transfer paper holding member 11, a paper sheet fed from the paper feeding portion 18 as been wound onto the outer peripheral surface of said holding member 11, with the leading edge of the paper sheet being caught by the claw portion 19, and it is so timed that the yellow toner image on the photoreceptor drum comes to a predetermined position of the paper sheet.

After transferring the yellow toner image on the photoreceptor 8 onto the copy paper by the action of the transfer charger 20, the surface of the photoreceptor 8 is cleaned by the cleaner 12, and here, in order to electrostatically rest the photoreceptor, the drum 8 was rotated, with the discharged of the corona charger 9 being suspended for 3 seconds. Thereafter, the image forming process for magenta was effected in the similar manner as for yellow. Subsequently, the image forming processes for cyan and black were effected in the similar manner as the process for magenta after providing the electrostatic rest step for 3 seconds. In the above case, at the developing portion 10, each developing unit to be used according to the required color was directed to the photoreceptor drum so as to ready for the developing. In the manner as described above, toner images in four colors were transferred in the overlapped state onto the paper sheet on the transfer sheet holding member 11, thereby to form the color image on the paper sheet. After transferring toner images for all colors, the paper sheet was separated from the holding member 11 by the separating claw 21, and thus, the images were fixed by the fixing device 23 through the transport portion 22. In the manner as described above, beautiful color images could be obtained even under the conditions at environmental temperature of 40° C.

Embodiment 6

Figure 11:
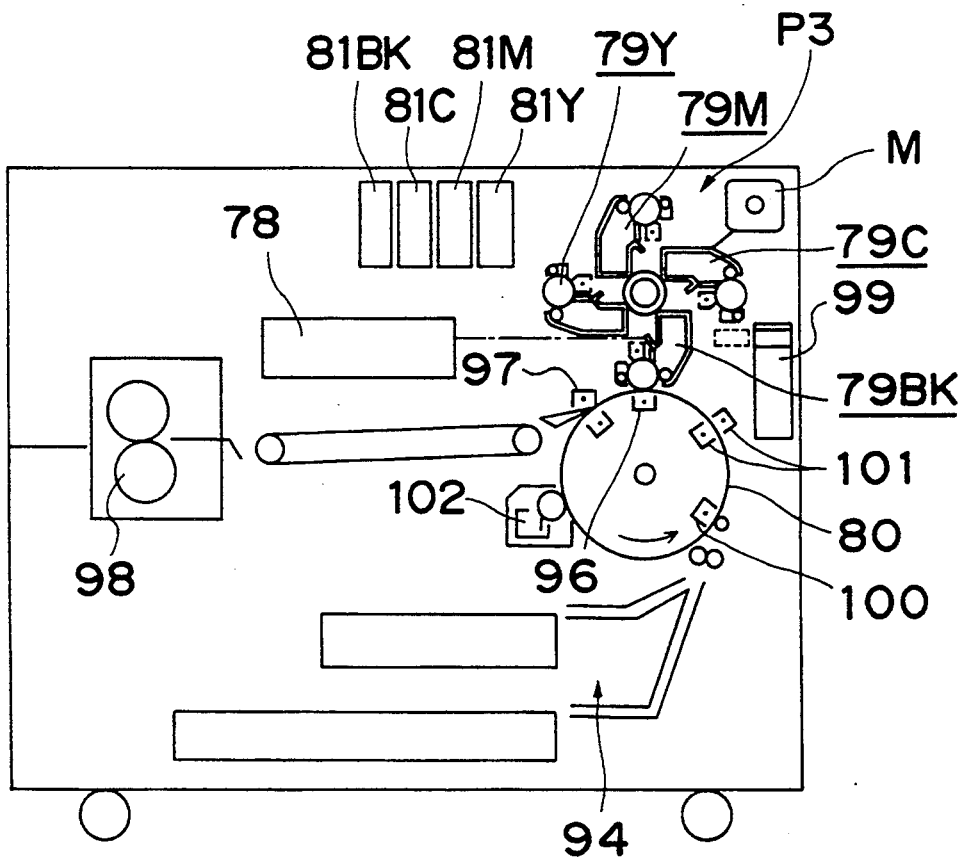
FIG. 11 is a schematic side sectional view of a color electrophotographic apparatus according to another embodiment of the present invention showing the state of the printer portion during operation.

Reference is further made to FIG. 11 mainly showing an image forming portion of a color electrophotographic apparatus according to another embodiment of the present invention.

Figure 12:
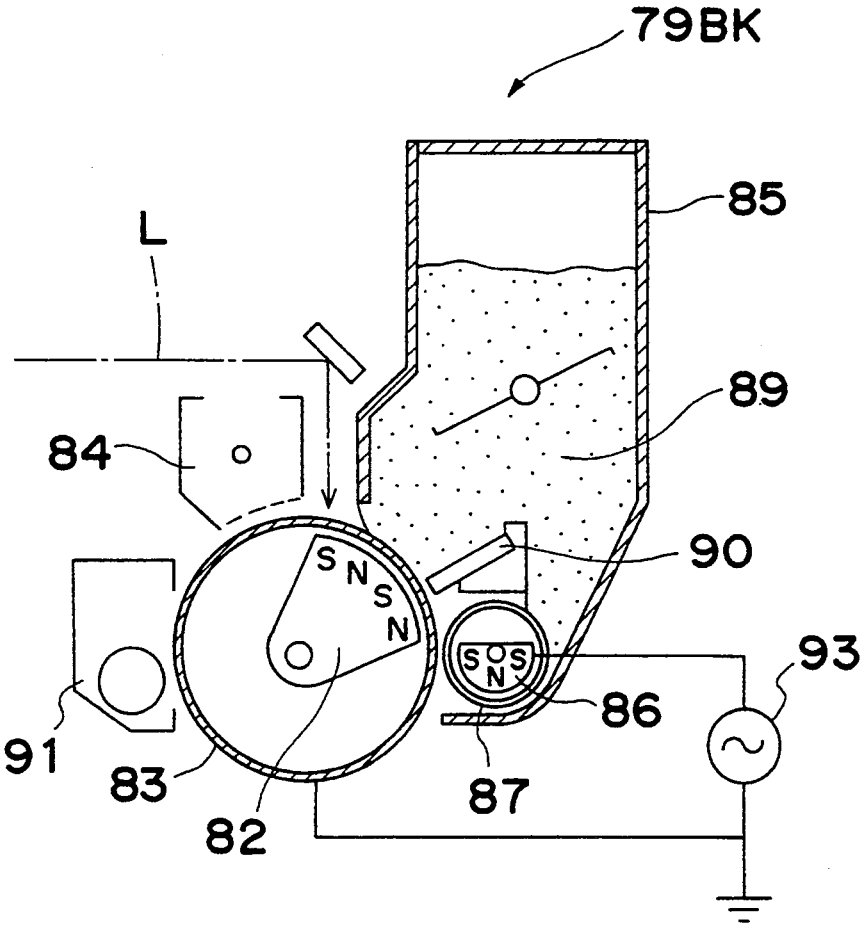
FIG. 12 is a schematic side sectional view of an image forming unit for black employed in the arrangement of FIG. 11.

In FIG. 11, color digital signals are inputted to the printer portion P3 so as to be fed to a laser light exposure device 78. Within the printer portion P3, there are disposed four sets of image forming units 79BK, 79C, 79M, and 79Y in an annular shape, which are rotatable on the whole so that each unit is arranged to sequentially confront a transfer paper holding member 80 by a moving means M. Toner hoppers 81BK, 81C, 81M and 81 Y respectively for black, cyan, magenta and yellow are connected to the group of the image forming units by supply pipes (not shown). Since each of the image forming units 79 is composed of the same constitutional parts except for the developing material to be accommodated therein, description will be given only with respect to the image forming unit 79BK for black, and explanation for the units of other colors is abbreviated for brevity, with like parts being designated by like reference numerals affixed with letters representing colors for quick reference. Thus, the representative image forming unit 79BK for black as shown on an enlarged scale in FIG. 12 is provided with a rotatable photosensitive or photoreceptor drum 83 having a magnet 82 enclosed therein, a corona charger 84, and a developing material hopper 85, a toner collecting electrode roller 87 having a magnet 86 enclosed therein, a toner restricting plate 90 provided above and adjacent to said roller 87 which is connected to an A.C. high voltage source 93, and a cleaner 91 with a dual-component developing material 89 being contained in said hopper 85. Within the photoreceptor drum 83, the magnet 82 is fixed in its position, with the pole position thereof facing the interior of the toner hopper 85. The surface of the photoreceptor drum 83 is charged at −400 V by the corona charger 84, and thereafter, exposed to laser light L to be formed with an electrostatic latent image thereon. Then, the dual-component developing material 89 contained in the hopper 85 is magnetically attracted onto the surface of the photoreceptor drum 83 so as to adhere the toner onto the surface of the photoreceptor drum 83 for developing the electrostatic latent image formed thereon into a visible toner image. The amount of toner to be adhered onto the surface of the photoreceptor drum 83 is restricted by the toner restricting plate 90 to a thickness of about 0.3 to 3 mm, and thereafter, the adhered toner is passed in front of the toner collecting electrode roller 87 disposed to confront the surface of the photoreceptor drum 83 through a gap of about 0.4 mm as the photoreceptor drum 83 rotates. For developing the latent image on the photoreceptor into the visible image, in addition to the carrier attracting function of the fixed magnet 86 disposed within the toner collecting electrode roller 87, the A.C. voltage (frequency: 1KHz, AC:1K Vrms, DC bias: −350 V) was applied to the toner collecting electrode roller 87 by the A.C. high voltage source 93.

Referring back to FIG. 11, the process of forming a full color image will be explained hereinafter.

From a tray for a required size of a paper feeding unit 94, a transfer paper (not particularly shown) is supplied so as to be wound around the transfer paper holding member 80 composed of a polyester film of 100 μm in thickness. In the first place, the image forming unit 79BK for black is directed to the image forming position so as to expose the black component signal light through the laser light L. The latent image formed thereby is developed into a visible toner image in the image forming unit 79BK, and said toner image is transferred onto the paper sheet by the action of a transfer charger 96. Then, the image forming unit 79C for cyan is displaced by rotating the entire group of the image forming units, to the position where the image forming unit 79BK for black was present for replacement therewith, and similar image forming process was repeated by using the image forming unit 79C for cyan, subsequently, the image forming unit 79M for magenta, and finally, the image forming unit 79Y for yellow, and thus, a beautiful full color image was obtained on the transfer paper sheet. Thereafter, the paper sheet was separated from the transfer paper holding member by a separating charger pair 97 for heat fixing of the image by a fixing unit 98, and thus, the desired full color image was obtained.

At the right upper portion in FIG. 11, a toner collecting portion 99 is provided so as to collect toner from the cleaner of the image forming unit 79C located at the position as shown, and such collection of toner is sequentially effected every time each of the image forming unit arrives at this position. Around the transfer paper holding member 80, there are further provided a charger 100 for attracting the transfer paper fed from the paper feeding unit 94, onto said holding member 80, erasers 101 for erasing the transfer paper holding member 80 and the transfer paper during formation of the above full color image, and a cleaner 102 for cleaning the surface of said holding member 80 after completion of the image formation.

In the above embodiment of the color electrophotographic apparatus as explained so far, although it is stated to employ the dual-component developing material, similar effects may also be obtained even when the magnetic mono-component toner is used at least for the image forming unit for black. Moreover, in the developing method of each image forming unit, although explanation has been given based on the developing method in which the developing material layer is preliminarily formed on the surface of the photoreceptor drum, it is needless to say, that the same effect is available by the ordinary developing method wherein the developing material layer is formed on a developing material support member.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A color electrophotographic apparatus which comprises a plurality of movable image forming units each having at least a photosensitive member and a developing unit, a transfer paper holding member for holding transfer paper so as to transfer toner image onto the transfer paper, and an exposure means, with the respective developing units of said image forming units having toner in a plurality of colors each of said image forming units having a first image forming position confronting said transfer paper holding member, and a second image forming position different from said first image forming position.

2. A color electrophotographic apparatus which comprises a plurality of movable image forming units each having at least a photosensitive member and a developing unit, a transfer paper holding member for holding transfer paper so as to transfer toner image onto the transfer paper, and an exposure means, with the respective developing units of said image forming units having toner in a plurality of colors, said color electrophotographic apparatus including a color mode and a single color mode, and a moving means of said image forming units so controlled as to displace said image forming units in turn, to a first image forming position during said color mode, whereby, after forming an electrostatic latent image on the photosensitive member of said image forming unit by the exposure means and developing said electrostatic latent image by toner, toner images of the respective colors are successively transferred onto the paper sheet held on the transfer paper holding member to form the color image on the transfer paper, and, to displace a predetermined image forming unit to a second image forming position during said single color mode, with the toner image in the single color developed thereat being transferred onto the paper sheet without employing said transfer paper holding member.

3. A color electrophotographic apparatus which comprises a plurality of movable image forming units each having at least a photosensitive member and a developing unit, a transfer paper holding member for holding transfer paper so as to transfer toner image onto the transfer paper, and an exposure means, with the respective developing units of said image forming units having toner in a plurality of colors, said color electrophotographic apparatus including a color mode and a single color mode, each of said image forming units having a first image forming position confronting said transfer paper holding member, and a second image forming position spaced from said transfer paper holding member, said exposure means being arranged to be changed over between a first state acting on the image forming unit at said first image forming position during the color mode, and a second state acting on the image forming unit at said second image forming position during the single color mode.

4. A color electrophotographic apparatus which comprises a plurality of movable image forming units each having at least a photosensitive member and a developing unit, a transfer paper holding member for holding transfer paper so as to transfer toner image onto the transfer paper, and a paper feeding means for feeding the paper for transfer to an image forming portion, with the respective developing units of said image forming units having toner in a plurality of colors, said color electrophotographic apparatus including a color mode and a single color mode, each of said image forming units having a first image forming position confronting said transfer paper holding member, and a second image forming position spaced from said transfer paper holding member, said paper feeding means begin arranged to be changed over between a first state for feeding the paper to said transfer paper holding member during the color mode, and a second state for feeding the paper to the image forming unit at said second image forming position during the single color mode.

5. A color electrophotographic apparatus which comprises a plurality of image forming units each having at least a photosensitive member and a developing unit, a transfer paper holding member for holding transfer paper so as to transfer a toner image onto the transfer paper, and a single exposure device, the respective developing units of said image forming units having toner in a plurality of colors with a transfer position of said transfer paper holding member and the exposure position of said exposure device being fixed, said color electrophotographic apparatus further including a moving means of said image forming units so controlled as to rotate the group plurality of said image forming units on the whole and to displace said image forming units in turn, to the same image forming position during the color image formation, whereby, after forming an electrostatic latent image on the photosensitive member of said image forming unit by said exposure device and developing said electrostatic latent image by color toner, the toner images are transferred onto the paper sheet held on the transfer paper holding member to form the color image on the transfer paper.

6. A color electrophotographic apparatus as claimed in claim 5, wherein each of said image forming units has the photosensitive member adapted to move, with a fixed magnet enclosed therein, and a magnetic developing material, and also, includes a toner hopper containing the magnetic developing material in a position confronting said photosensitive member so as to cause the magnetic developing material to be magnetically attracted onto the surface of said photosensitive member for adhesion thereto, and a collecting roller for collecting unnecessary developing material in a position confronting the photosensitive member for visualizing the image on said photosensitive member.

7. A color electrophotographic apparatus which comprises a plurality of movable image forming units each having at least a photosensitive member and a developing unit, a transfer image holding member for holding transfer image so as to transfer toner image, and a single exposure device, the respective developing units of said image forming units having toner in a plurality of colors, with a transfer position of said transfer image holding member and the exposure position of said exposure device being fixed, said color electrophotographic apparatus further including a moving means of said image forming units so controlled as to displace said image forming units in turn, to the same image forming position during the color image formation whereby, after forming an electrostatic latent image on the photosensitive member of said image forming unit by said exposure device and developing said electrostatic latent image by toner, the toner images are transferred onto said transfer image holding member to form the color image thereon.

8. A color electrophotographic method which comprises the steps of forming respective single color images in a plurality of colors, and combining said respective single color images to form a color image, wherein, when time for using a photosensitive member during said respective single color image forming step for the color image formation is represented by T, and time for electrostatically resting the photosensitive member up to the next use of said photosensitive member, by t, a step in a relation of $T<t$ is repeated to form the color image.

9. A color electrophotographic method for continuously forming a same image for a plurality of times, which comprises the steps of forming a color image by combining a plurality of single color images, and electrostatically resting a photosensitive member employed therefor during continuous use thereof for the color image formation.

10. A color electrophotographic method which comprises the steps of forming respective single color images in a plurality of colors, and combining said respective single color images to form a color image, wherein time for electrostatically resting a photosensitive member employed therefor is provided between said respective single color image formations in the plurality of colors.

11. A color electrophotographic apparatus comprising:

(a) four movable image forming units each having a photosensitive member and a developing unit, a fixed magnet enclosed in each of said photosensitive members, a magnetic developing material, a toner hopper which holds the magnetic developing material and which, by being placed directly in front of the photosensitive member, causes said fixed magnet to attract said magnetic developing material onto the surface of the photosensitive member for adhesion thereto, and a collecting roller powered by an AC voltage for collecting and keeping away excessive developing material from an image while it is being formed on said photosensitive member, said image forming unit horizontally arranged to form a group of image forming units, (b) a single exposure device for exposing each of said photosensitive members at an image forming position thereof, (c) a transfer paper holding member for sequentially transferring the toner image from each of said photosensitive members onto a transfer paper at said image forming positions thereof to cause a color image formation, and (d) displacing means for sequentially displacing said group of image forming units to said respective image forming positions during said color image formation.

* * * * *

UNITED STATES PATENT AND TRADEMARK OFFICE

CERTIFICATE OF CORRECTION

PATENT NO. : 5,351,115
DATED : September 27, 1994
INVENTOR(S) : Yamamoto et al.

It is certified that error appears in the above-identified patent and that said Letters Patent is hereby corrected as shown below:

Column 16, line 36, the word "begin" should be --being--.

Column 16, line 54, the word "group" should be deleted.

Column 18, line 28, the word "unit" should be --units--.

Signed and Sealed this

Third Day of January, 1995

Bruce Lehman

*Attest:*

BRUCE LEHMAN

*Attesting Officer*

*Commissioner of Patents and Trademarks*